US006213171B1

(12) United States Patent
Saint-Ramon et al.

(10) Patent No.: US 6,213,171 B1
(45) Date of Patent: Apr. 10, 2001

(54) METHOD AND SYSTEM FOR FILLING A STRAW WITH A LIQUID

(75) Inventors: Jean-Gérard Saint-Ramon, L'Aigle; Christian Beau, Voisins le Bretonneux; Alain Ehrsam, Lyons, all of (FR)

(73) Assignee: IMV Technologies, L'Aigle (FR)

( * ) Notice: Subject to any disclaimer, the term of this patent is extended or adjusted under 35 U.S.C. 154(b) by 0 days.

(21) Appl. No.: 09/487,750

(22) Filed: Jan. 19, 2000

(30) Foreign Application Priority Data

Jan. 19, 1999 (FR) ..... 99 00499

(51) Int. Cl.[7] ..... B65B 31/00
(52) U.S. Cl. ..... 141/59; 141/7; 141/65
(58) Field of Search ..... 141/4, 5, 7, 8, 141/44, 59, 65; 422/102

(56) References Cited

U.S. PATENT DOCUMENTS

| | | | | |
|---|---|---|---|---|
| 3,687,175 | | 8/1972 | Babey . | |
| 4,363,205 | * | 12/1982 | Hollander, Jr. | 53/434 |
| 5,190,880 | | 3/1993 | Cassou et al. . | |
| 5,249,610 | * | 10/1993 | Cassou et al. | 141/130 |
| 5,283,190 | | 2/1994 | Cassou et al. . | |
| 5,868,178 | * | 2/1999 | Lecointe | 141/110 |

FOREIGN PATENT DOCUMENTS

| | | |
|---|---|---|
| 3820387 A1 | 12/1989 | (DE) . |
| 0 480 109 B1 | 10/1990 | (EP) . |
| 0 304 358 B1 | 3/1992 | (EP) . |
| 995 878 | 8/1951 | (FR) . |
| 2 762 210 | 4/1997 | (FR) . |

* cited by examiner

*Primary Examiner*—Gregory L. Huson
*Assistant Examiner*—Peter deVore
(74) *Attorney, Agent, or Firm*—Morgan & Finnegan, L.L.P.

(57) ABSTRACT

A method and a system are disclosed for filling a straw which is fitted with a stopper that is permeable to gases and impermeable to liquids and which has a diameter greater than or equal to approximately three millimeters with a liquid while it is vertical. A primary vacuum is established in the straw. The straw is then filled and a quantity of air remaining above the resulting column of liquid is evacuated, enabling homogeneous filling of the straw.

2 Claims, 2 Drawing Sheets

METHOD AND SYSTEM FOR FILLING A STRAW WITH A LIQUID

BACKGROUND OF THE INVENTION

1. Field of the Invention

The present invention relates to a method and a system for filling a straw with a liquid.

2. Description of the Prior Art

Straws, widely used to store small quantities of substances, in particular biological substances and especially biological liquids, were described for the first time in French patent No. 995 878. The straws, referred to as "French straws", used to include a three-part stopper made up of two wads of a fibrous substance with a powder between them which was transformed on contact with a liquid into an impermeable paste or gel adhering to the wall of the tube, creating a sealed stopper.

IMV TECHNOLOGIES straws with a three-part stopper are entirely satisfactory. Nevertheless, some absorption of the liquid contained in the straw has been observed, although at a very low level. IMV TECHNOLOGIES have therefore developed a straw with a hydrophobic microporous one-piece stopper also referred to as a "non-absorbent stopper". A straw of this kind is described in IMV TECHNOLOGIES' French patent application FR-A-2 762 210 of Apr. 21, 1997.

Straws with a three-part stopper are filled horizontally by aspiration. The liquid to be packaged is drawn into the horizontal straw using a suction pump. Filling a horizontal three-part stopper straw is described in particular in patent application EP-A-0 480 109 (IMV TECHNOLOGIES).

This system is entirely suitable for small diameter straws but is not suitable for large diameter straws. In the context of the present invention, the expression "large diameter" means a diameter greater than or equal to approximately 3 mm.

An object of the invention is to provide a method of filling large diameter straws with a liquid.

Other objects and advantages of the invention will become apparent on reading the following description.

SUMMARY OF THE INVENTION

The invention consists in a method of filling a straw fitted with a stopper that is permeable to gases and impermeable to liquids and having a diameter greater than or equal to approximately three millimeters with a liquid while it is vertical, in which method a primary vacuum is established in the straw, the straw is then filled and a quantity of air remaining above the resulting column of liquid is evacuated, enabling homogeneous filling of the straw.

Simple vertical filling using a positive displacement metering pump is already well known in the art, in particular in automatic laboratory equipment.

However, vertically filling a straw equipped with a non-absorbent stopper with controlled movement of the needle has many drawbacks associated with the large width of the straw compared to the diameter of the needle, in particular problems with the filling speed and accurate guiding of the needle (the needle may touch the wall of the straw and trap air bubbles).

In conventional vertical filling, the necessary filling time is long and air bubbles may be present during filling.

In contrast, the vertical filling method of the present invention does not require any controlled movement and offers a droplet collection facility.

Note that the method of the invention can also be applied to straws that do not have a large diameter, i.e. straws with a diameter less than approximately 3 mm.

What is more, the effects of gravity, viscosity and surface tension soil the lower part of the straw during horizontal filling and withdrawal of the nozzle.

Compared to horizontal filling, vertical filling in accordance with the present invention has the advantage that there is no soiling in the sealing area, which is a guarantee of safe conservation of the packaged product.

Vertical filling in accordance with the invention also limits emulsion of the foaming solutions.

However, the method of the invention is not suitable for straws with a three-part stopper.

The present invention also proposes a system for filling a straw having a diameter greater than or equal to approximately three millimeters using a method as defined hereinabove, the system including:

- a suction pump for establishing a primary vacuum in the straw,
- a positive displacement pump for filling the straw,
- a filler nozzle, and
- a base including a filler needle connected to the positive displacement pump and a vent for evacuating the quantity of air remaining above the resulting column of liquid.

The invention will be described in more detail with reference to the accompanying drawings.

DETAILED DESCRIPTION OF THE PREFERRED EMBODIMENT

Figure 3:
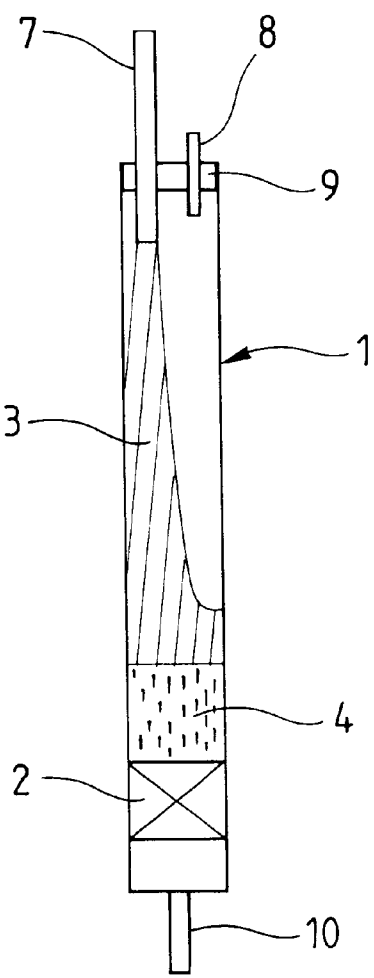
FIGS. 1 to 5 are diagrammatic views of a straw in various phases of the filling method of the invention.

To facilitate understanding the invention, FIGS. 1 to 5 show a straw 1 with a filler needle 7 and a vent 8 disposed on a base 9 with a connector 10 connected to a suction pump.

The straw 1 in accordance with the invention has a diameter "d" greater than or equal to 3 mm and a stopper 2 that is permeable to gases and impermeable to liquids.

Figure 6:
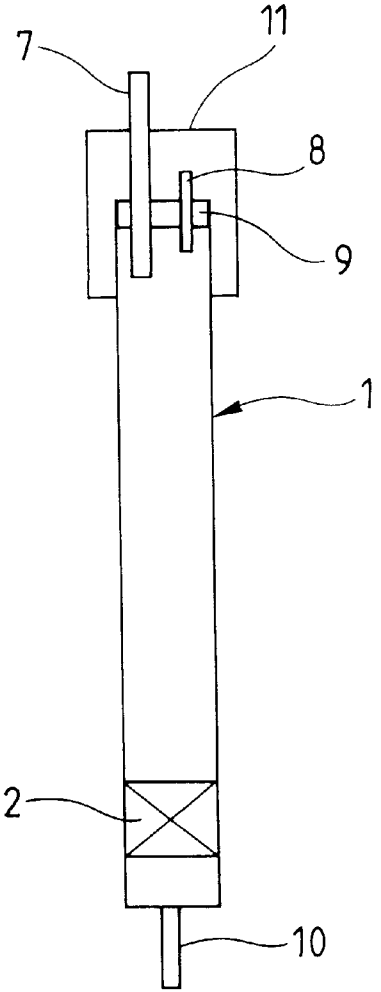
FIG. 6 is a diagram showing the filling system of the invention.

A connector 10 connected to a suction pump (not shown) is placed at the end of the straw containing the stopper. A filler nozzle 11 is placed at the end of the straw opposite the stopper (see FIG. 6). A filler needle 7 is connected to a positive displacement metering pump (not shown) and has a droplet collection facility and a vent 8. The filler needle 7 and the vent 8 are on a base 9.

Figure 2:
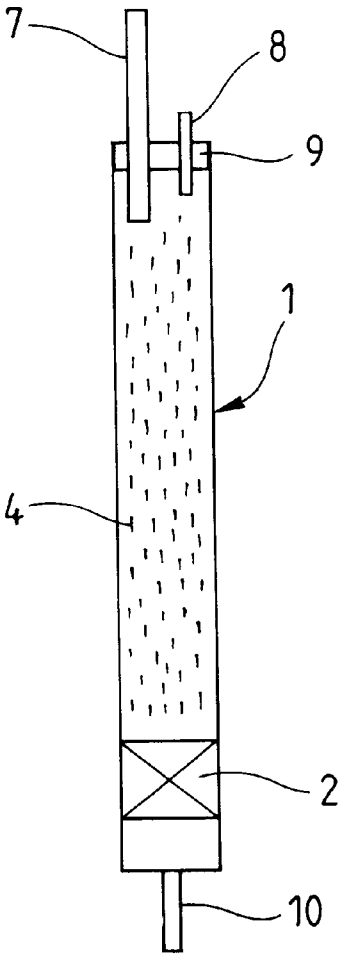
Figure 1:
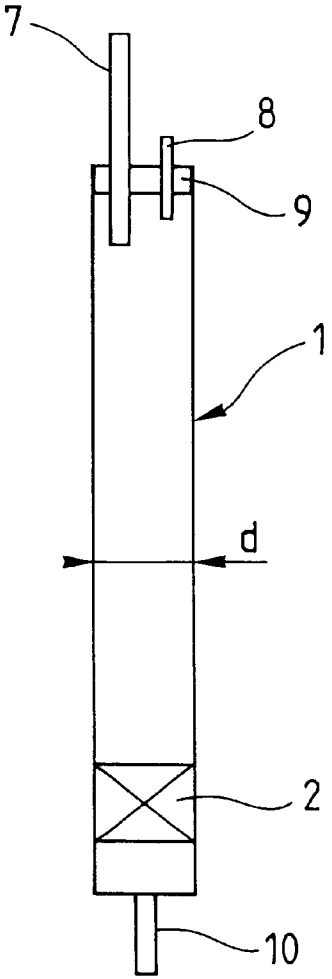

In FIG. 2, a primary vacuum has been established inside the straw.

In FIG. 3, the straw is beginning to be filled with the liquid 3. There is still an "evacuated" area 4 near the stopper.

Figure 4:
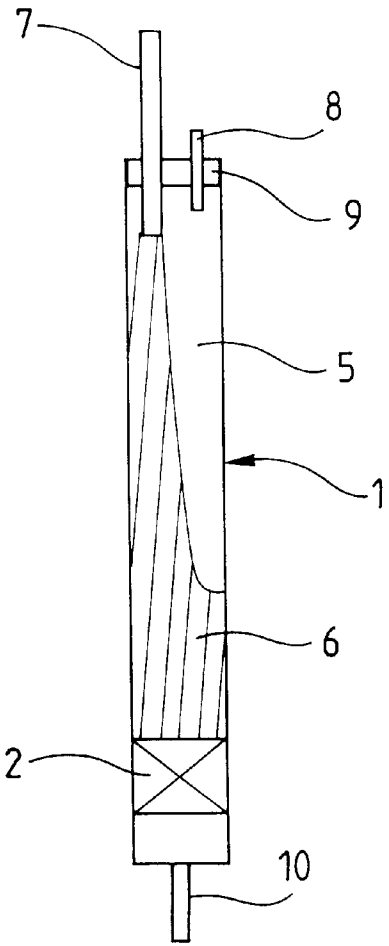

In FIG. 4, filling of the straw is continuing; there is no longer any "evacuated" area near the stopper; a volume of air 5 remains above the column of liquid 6.

Figure 5:
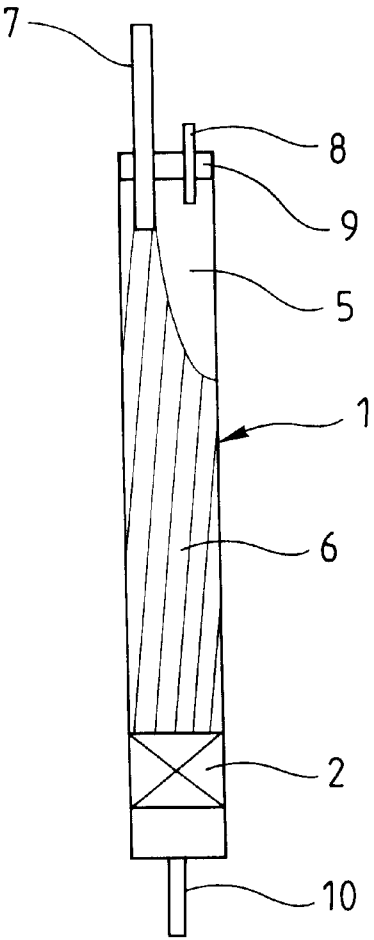

In FIG. 5, evacuation of the remaining volume of air 5 is continuing.

The filled straw is then sealed in a manner that is well known in the art, for example as described in EP-A-0 304 358 (IMV TECHNOLOGIES).

In one non-limiting example of the present invention, a straw having a volume of 2 ml and an inside diameter of 5.2 mm is filled using a filler needle having a diameter of 2 mm. The suction pump causes a pressure drop of approximately 800 mm of Hg. The flowrate is approximately 10 l/min.

The skilled person will understand that particular embodiments of the invention have been described and shown and that many variants are feasible that remain within the scope of the invention as defined in the appended claims.

There is claimed:

1. A method of filling a straw fitted with a stopper that is permeable to gases and impermeable to liquids and having a diameter greater than or equal to approximately three millimeters with a liquid while it is vertical, in which method a primary vacuum is established in said straw, said straw is then filled and a quantity of air remaining above the resulting column of liquid is evacuated, enabling homogeneous filling of said straw.

2. A system for filling a straw having a diameter greater than or equal to approximately three millimeters using a method as claimed in claim 1, said system including:

a suction pump for establishing a primary vacuum in said straw, a positive displacement pump for filling said straw, a filler nozzle, and a base including a filler needle connected to said positive displacement pump and a vent for evacuating said quantity of air remaining above said resulting column of liquid.

* * * * *